United States Patent [19]

Chalek et al.

[11] Patent Number: 4,591,759

[45] Date of Patent: May 27, 1986

[54] INGREDIENTS FOR SOLENOIDAL METAL HALIDE ARC LAMPS

[75] Inventors: Carl L. Chalek, Scotia; Peter D. Johnson, Schenectady, both of N.Y.

[73] Assignee: General Electric Company, Schenectady, N.Y.

[21] Appl. No.: 649,033

[22] Filed: Sep. 10, 1984

[51] Int. Cl.[4] ..... H01J 61/18

[52] U.S. Cl. ..... 313/638; 313/642; 313/161

[58] Field of Search ..... 313/638, 639, 642, 161

[56] References Cited

U.S. PATENT DOCUMENTS

| | | | |
|---|---|---|---|
| 3,860,854 | 1/1975 | Hollister | 315/248 |
| 3,958,145 | 5/1976 | Jack et al. | 313/184 |
| 4,017,764 | 4/1977 | Anderson | 315/248 |
| 4,180,763 | 12/1929 | Anderson | 315/248 |
| 4,206,387 | 6/1980 | Kramer et al. | 315/248 |
| 4,422,011 | 12/1983 | Bruninx-Poesen et al. | 313/642 |
| 4,427,924 | 1/1984 | Proud et al. | 315/248 |

FOREIGN PATENT DOCUMENTS 1444023 7/1976 United Kingdom .

OTHER PUBLICATIONS

C. Hirayama et al., *Complex Halide Vapors in Metal Halide Type HID Lamps*, Journal of IES, Jul. 1977, pp. 209–214.

*Primary Examiner*—David K. Moore
*Assistant Examiner*—K. Wieder
*Attorney, Agent, or Firm*—Mark L. Mollon; James C. Davis, Jr.; Marvin Snyder

[57] ABSTRACT

Halides of aluminum or tin, or other metals, in combination with sodium chloride in the presence of mercury and excess aluminum or tin metal are used as a fill material in a solenoidal metal halide arc lamp. This fill results in very good color and a high efficacy.

10 Claims, 1 Drawing Figure

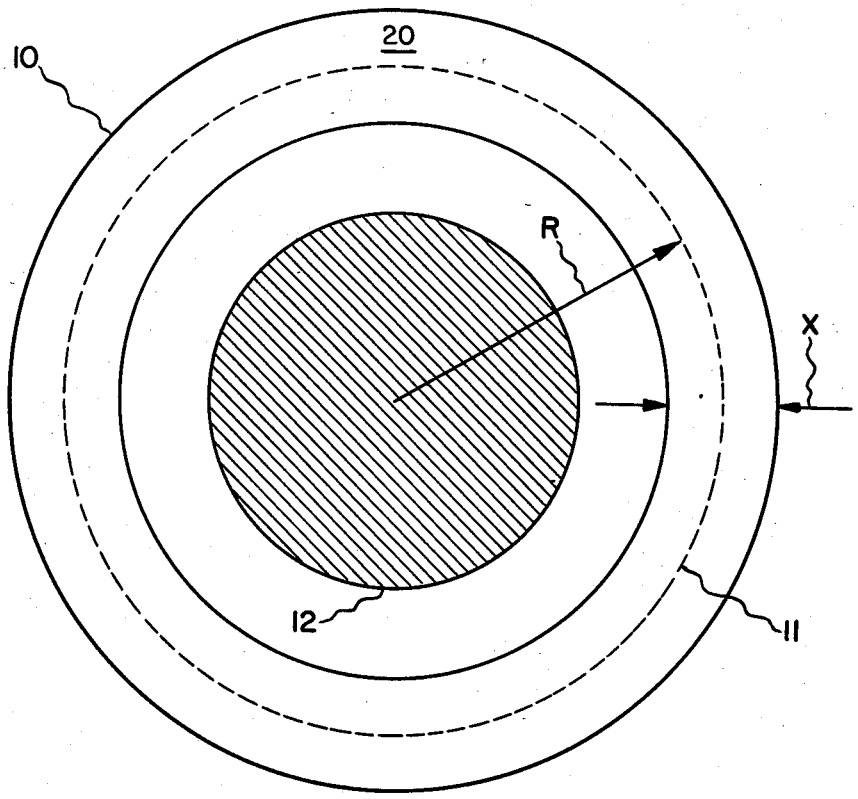
20
10
R
X
12
11

INGREDIENTS FOR SOLENOIDAL METAL HALIDE ARC LAMPS

The present invention relates in general to ingredients for electrodeless solenoidal metal halide arc lamps and more specifically to such lamps with improved color and efficacy.

BACKGROUND OF THE INVENTION

The chlorides of aluminum and tin produce nearly continuous white light when used in high intensity discharge lamps. However, chlorine is highly reactive with tungsten resulting in the destruction of the lamp electrode. It is possible to protect the electrodes by adding iodide to the lamp but this results in loss of efficacy.

Electrodeless lamps using solenoidal electric fields to support high intensity discharges provide an opportunity to use lamp ingredients which would otherwise cause destruction of the lamp electrodes. An electrodeless high intensity discharge solenoidal electric field (HID-SEF) lamp is essentially a transformer which couples radio-frequency energy to a plasma, the plasma acting as a single-turn secondary. A magnetic field, changing with time, creates an electric field within the lamp which closes completely upon itself and which excites the plasma to create a high intensity discharge. HID-SEF lamp structures are the subject matter of U.S. Pat. No. 4,017,764 and U.S. Pat. No. 4,180,763, both issued to J. M. Anderson and assigned to the assignee of the present invention, both patents being incorporated herein by reference.

Fills for HID-SEF lamps previously used include (1) inert gases, (2) rare earth compounds, (3) mercury, (4) metallic halides and (5) mercury halide combined with nitrogen and iodine.

OBJECTS OF THE INVENTION

It is a principle object of the present invention to provide a new and improved fill for high intensity discharge solenoidal electric field lamps which results in excellent color rendering and high efficacy.

It is another object of the present invention to combine metal halides with sodium chloride as a fill material in electrodeless high intensity discharge solenoidal electric field lamps.

SUMMARY OF THE INVENTION

These and other objects of the present invention are achieved according to the present invention by combining a metal halide with sodium chloride in the presence of mercury and optionally with an excess of aluminum or tin metal. The lamp fill material may further include an inert gas such as argon. The preferred metals for the metal halide are aluminum and tin.

These and other aspects of the invention, together with the features and advantages thereof, will become apparent from the following detailed specification, when read with the accompanying drawing.

BRIEF DESCRIPTION OF THE DRAWING

The sole drawing FIGURE is a top cross-sectional view of an exemplary solenoidal electric field lamp.

DETAILED DESCRIPTION OF THE INVENTION

Referring now to the drawing, a toroidally shaped arc envelope 10 is shown in cross section and has a cross-sectional diameter X. A magnetic core 12 passing through arc envelope 10 is excited by a primary winding (not shown). A fill 20 for the solenoidal metal halide arc lamp is contained by arc envelope 10.

During operation of the lamp, the varying magnetic field emanating from magnetic core 12 induces an electric field within the lamp which causes current to flow, ionizing fill 20. The excited fill produces a high intensity discharge along a discharge path 11 at a radius R from the center of magnetic core 12.

The ingredients for fill 20 are the subject of the present invention. One ingredient in fill 20 is a metal halide wherein the metal is aluminum, tin, mercury, copper, lead, zinc or antimony and the halogen is chlorine or bromine. The metal halide produces nearly continuous white light in the arc discharge. Sodium chloride is added to the fill to lower the color temperature and increase the efficacy of the arc discharge. The combination of the metal halide with sodium chloride enhances the vaporization of sodium in the arc discharge by the formation of higher vapor pressure complexes, such as $NaSnCl_x$ where x is 3 to 5. The majority of the radiative output results from atomic radiation from sodium and molecular radiation from halogen and metal monohalide. Mercury is also added to the fill to control the arc voltage and to allow impedance matching of the lamp. To a lesser extent, mercury also contributes to the radiative output.

An excess of aluminum or tin may also be added to the fill to reduce the amount of mercury halides present in the arc, thus avoiding hard starting, drop out and any increase in starting and reignition voltages which could be caused by excess mercury halides. One or more inert gases may also be added at pressures of about 0.0625 T/cm of arc to aid in starting.

EXAMPLE I

In this example, arc envelope 10 had a diameter X of 14 millimeters. Radius R from the center of core 12 to discharge path 11 at the center of arc envelope 10 was 1.75 inches. Envelope 10 was filled with 19.5 mg. of $Hg_2Cl_2$, 22 mg of NaCl, 24.4 mg of Hg, 7.6 mg of Sn and 2 torr of Ar. In arc envelope 10, the Sn replaced the Hg in $Hg_2Cl_2$, thus forming the wanted tin halide. It would be difficult to otherwise add tin halide to arc envelope 10 because of its hydroscopic property, i.e. its tendency to absorb water from the atmosphere. In this example, all of the tin is converted to metal halide. Several more milligrams of tin could be added to achieve an excess of tin.

When operated, the lamp of Example I had very good color, an arc voltage of 368 volts and an efficacy of 62 lumens per arc watt.

EXAMPLE II

Arc envelope 10, with the dimensions given in Example I, may be filled with 5 mg of Al, 25 mg of $Hg_2Cl_2$, 25 mg of NaCl, 25 Mg of Hg and 2 to 20 torr of Ar. After the Al reacts with the $Hg_2Cl_2$, 1.5 mg of excess Al remains.

The foregoing has demonstrated a fill for electrodeless SEF-HID lamps. The fill results in an arc discharge of excellent color and high efficacy.

While preferred embodiments of the present invention have been shown and described herein, it will be obvious that such embodiments are provided by way of example only. Numerous variations, changes, departures, substitutions and partial and full equivalents will occur to those skilled in the art without departing from the invention herein. Accordingly, it is intended that the invention be limited only by the spirit and scope of the appended claims.

What is claimed is:

1. A solenoidal metal halide arc lamp fill for supporting an arc discharge comprising:

a metal halide comprised of the combination of a metal selected from the group consisting of aluminum, tin, mercury, copper, lead, zinc and antimony with a halogen selected from the group consisting of chlorine and bromine, said metal halide producing substantially continuous white light when in said arc discharge;

sodium chloride for lowering the color temperature and increasing the efficacy of said arc discharge, the amount of said sodium chloride being sufficient to enhance sodium vaporization in said arc discharge by the formation of $NaMCl_x$, where M is said metal and where x is 3 to 5; and mercury for controlling the arc voltage of said arc discharge.

2. The fill of claim 1 further comprising an excess metal selected from the group consisting of aluminum and tin.

3. The fill of claim 1 further comprising an inert gas.

4. The fill of claim 1 wherein said metal in said metal halide is aluminum.

5. The fill of claim 1 wherein said metal in said metal halide is tin.

6. A solenoidal metal halide arc lamp comprising:

a light-transmissive arc envelope;

a fill disposed in said arc envelope, said fill including a metal halide comprised of the combination of a metal selected from the group consisting of aluminum, tin, mercury, copper, lead, zinc and antimony with a halogen selected from the group consisting of chlorine and bromine, and said fill further including sodium chloride and mercury, the amount of said sodium chloride being sufficient to enhance sodium vaporization in a high intensity discharge by the formation of $NaMCl_x$, where M is said metal and where x is 3 to 5; and means for coupling energy to said fill to produce said high intensity discharge in said arc envelope.

7. The lamp of claim 6 wherein said fill further includes an excess metal selected from the group consisting of aluminum and tin.

8. The lamp of claim 6 wherein said fill further includes an inert gas.

9. The lamp of claim 6 wherein said metal in said metal halide is aluminum.

10. The lamp of claim 6 wherein said metal in said metal halide is tin.

* * * * *